US005862784A

United States Patent [19]

Blowers

[11] Patent Number: 5,862,784

[45] Date of Patent: Jan. 26, 1999

[54] HYDRAULIC LASH ADJUSTER AND CHECK VALVE OPENING ARRANGEMENT THEREFOR

[75] Inventor: Bryan K. Blowers, Battle Creek, Mich.

[73] Assignee: Eaton Corporation, Cleveland, Ohio

[21] Appl. No.: 71,010

[22] Filed: May 1, 1998

[51] Int. Cl.[6] ..... F01L 1/16; F01L 1/24; F01M 9/10

[52] U.S. Cl. ..... 123/90.36; 123/90.35; 123/90.37; 123/90.43; 123/90.57

[58] Field of Search ..... 123/90.35, 90.36, 123/90.37, 90.39, 90.41, 90.43, 90.46, 90.48, 90.49, 90.52, 90.55, 90.57

[56] References Cited

U.S. PATENT DOCUMENTS

| | | | |
|---|---|---|---|
| 3,587,539 | 6/1971 | Dadd | 123/90.43 |
| 4,004,558 | 1/1977 | Scheibe | 123/90.35 |
| 4,184,464 | 1/1980 | Svihlik | 123/90.55 |
| 4,462,353 | 7/1984 | Arai et al. | 123/90.43 |
| 4,469,061 | 9/1984 | Ajiki et al. | 123/90.43 |
| 5,622,147 | 4/1997 | Edelmayer | 123/90.35 |
| 5,758,613 | 6/1998 | Edelmayer et al. | 123/90.36 |

*Primary Examiner*—Weilun Lo
*Attorney, Agent, or Firm*—L. J. Kasper

[57] ABSTRACT

A hydraulic lash adjuster of the type in which the plunger assembly (15) includes a ball plunger element (50), and defines a valve opening (57) in the lower plunger member (19). A check valve member (53) is seated in the valve opening (57), for opening the valve opening in response to a relative decrease in the pressure in a high pressure chamber (23). The ball plunger element (50) includes a metering valve element (45) movable between an outward position (FIG. 1) and an inward position (FIG. 2). An elongated member (65) is fixed to move with the metering element (45), and includes a lower end (67) juxtaposed the valve opening (57). When the metering element (45) is in its inward position, the lower end (67) engages the check ball (53) and lifts it from the valve opening, thus facilitating assembly of the lash adjuster, filled with fluid, into an engine.

5 Claims, 2 Drawing Sheets

HYDRAULIC LASH ADJUSTER AND CHECK VALVE OPENING ARRANGEMENT THEREFOR

BACKGROUND OF THE DISCLOSURE

The present invention relates generally to hydraulic lash adjusters, and more particularly to a hydraulic lash adjuster (HLA) of the type in which a check valve provides at least some of the leakdown flow from the pressure chamber to the reservoir.

Hydraulic lash adjusters (also sometimes referred to as "lifters") for internal combustion engines have been in use for many years to eliminate clearance, or lash, between engine valve train components under varying operating conditions, in order to maintain efficiency and to reduce noise and wear in the valve train. Hydraulic lash adjusters operate on the principle of transmitting the energy of the valve actuating cam through hydraulic fluid, trapped in a pressure chamber under a plunger. During each operation of the cam, as the length of the valve actuating components varies as a result of temperature changes and wear, small quantities of hydraulic fluid are permitted to enter the pressure chamber, or escape therefrom, thus effecting an adjustment in the position of the plunger, and consequently adjusting the effective total length of the valve train.

The cam operating cycle comprises two distinct events: (1) operation on the base circle and (2) valve actuation. The base circle event is characterized by a constant radius between the cam center of rotation and the cam follower, and during this event, no cam energy is transmitted. The valve actuation event is characterized by a varying radius between the cam center of rotation and the cam follower, which effectively transmits cam energy to open and close an engine valve. During the valve actuation event, a portion of the load resulting from the valve spring, the inertia of valve train components, and cylinder pressure are transmitted through the valve train and through the lash adjuster. The load increases the pressure of the hydraulic fluid within the lash adjuster pressure chamber, in proportion to the plunger area, and in typical hydraulic lash adjusters currently in commercial production, fluid escapes the pressure chamber between the plunger and the wall of the lash adjuster body. Such a device is referred to as a "conventional leakdown" lash adjuster.

As the fluid escapes, the volume of the pressure chamber is decreased and the plunger moves down, shortening the effective length of the lash adjuster. During the base circle event, the lash adjuster plunger spring moves the plunger up within the body such that no clearance or lash exists between valve actuation components. As this occurs, hydraulic fluid is drawn into the pressure chamber through the plunger check valve in response to the increasing volume of the pressure chamber as the plunger moves up. If the effective length of the valve train shortens during the valve actuation cycle, positive lash is created and the lash adjuster extends, moving the plunger to a higher position at the end of the cycle than at the beginning. Conversely, if the effective length of the valve train increases during the valve actuation cycle, negative lash is created and the lash adjuster contracts, moving the plunger to a lower position at the end of the cycle than at the beginning. The latter condition typically occurs when valve train components lengthen in response to increasing temperature.

As noted previously, commercial lash adjusters of the conventional leakdown type have controlled the escape of fluid from the high pressure chamber (or "leakdown") solely by the fit of the plunger within the body, thus necessitating close clearances therebetween, and selective fitting of the plunger to the body. In an effort to overcome the expense of such selective fitting of the plunger within the body, as well as other associated disadvantages of the prior art, the assignee of the present invention has developed a lash adjuster in which the leakdown flow is past the plunger check valve. This improved lash adjuster is illustrated and described in U.S. Pat. No. 5,622,147 for a "HYDRAULIC LASH ADJUSTER", assigned to the assignee of the present invention and incorporated herein by reference.

Lash adjusters of the type disclosed in the above-identified patent are referred to as having "sealed leakdown" systems. In connection with the development of the sealed leakdown type lash adjusters, it has been determined that it is necessary to assemble such lash adjusters into the engine without fluid (i.e., assemble the lash adjuster "dry"), and after the engine begins to run, oil is pumped into the lash adjuster in a manner well known to those skilled in the art. If such lash adjusters were already filled with hydraulic fluid, prior to assembly into the engine, the assembly process would be nearly impossible. In a sealed leakdown lash adjuster, the check valve constitutes the only fluid passage between the high pressure chamber and the reservoir so that a compressive load imposed on the plunger results in fluid being displaced through the check valve. During the assembly process, at normal assembly speeds, the hydrodynamic forces generated by the flow of fluid through the check valve are sufficient to close the check valve before the lash adjuster is shortened enough to permit assembly.

In response to the above-described problems, those skilled in the art have developed an HLA of the "normally biased open" type, i.e., the check valve comprises a check ball (also referred to as a "freeball" check valve), which is normally biased toward an open position. For example, in co-pending application U.S. Ser. No. 792,809, filed Jan. 30, 1997, now U.S. Pat. No. 5,758,613, for a "HYDRAULIC LASH ADJUSTER AND BIASED NORMALLY OPEN CHECK VALVE SYSTEM THEREFORE", assigned to the assignee of the present invention, and incorporated herein by reference, the check ball is biased by a compression spring toward the open position. Although the structure of the incorporated application functions in a satisfactory manner, the addition of the biasing spring adds to the overall expense of the HLA, and does add some complication to the assembly process.

BRIEF SUMMARY OF THE INVENTION

Accordingly, it is an object of the present invention to provide an improved hydraulic lash adjuster of the sealed leakdown type which makes it feasible to fill the lash adjuster with hydraulic fluid prior to assembly into the engine.

It is another object of the present invention to provide an improved hydraulic lash adjuster which can readily be collapsed, thus making it re-useable, or serviceable.

The above and other objects of the invention are accomplished by the provision of a hydraulic lash adjuster for an internal combustion engine, the lash adjuster comprising a body defining a blind first bore formed therein. A plunger assembly is slidingly received within the blind first bore, and a pressure chamber is defined by the blind first bore and the plunger assembly. A fluid chamber is disposed within the plunger assembly, and a supply of hydraulic fluid is within the fluid chamber. The plunger assembly defines a valve opening providing fluid communication between the pressure chamber and the fluid chamber, and a check valve member is operatively associated with the valve opening for opening or closing the valve opening in response to a relative decrease or a relative increase, respectively, in the pressure in the pressure chamber. A biasing means normally urges the plunger assembly outward of the blind first bore. The plunger assembly includes a ball plunger element adapted for engagement with an adjacent surface of a valve train component, the ball plunger element defining a lubrication passage and a metering element reciprocally disposed within the lubrication passage. The metering element is moveable between an outward position when pressure in the fluid chamber is relatively higher, and an inward position when pressure in the fluid chamber is relatively lower.

The improved hydraulic lash adjuster is characterized by an elongated member operably associated with the metering element, and including a lower end juxtaposed the valve opening and the check valve member when the metering element is in the outward position. The elongated member is configured to engage the check valve member and lift the check valve member to open the valve opening when the metering element is in the inward position.

DETAILED DESCRIPTION OF THE PREFERRED EMBODIMENT

Figure 1:
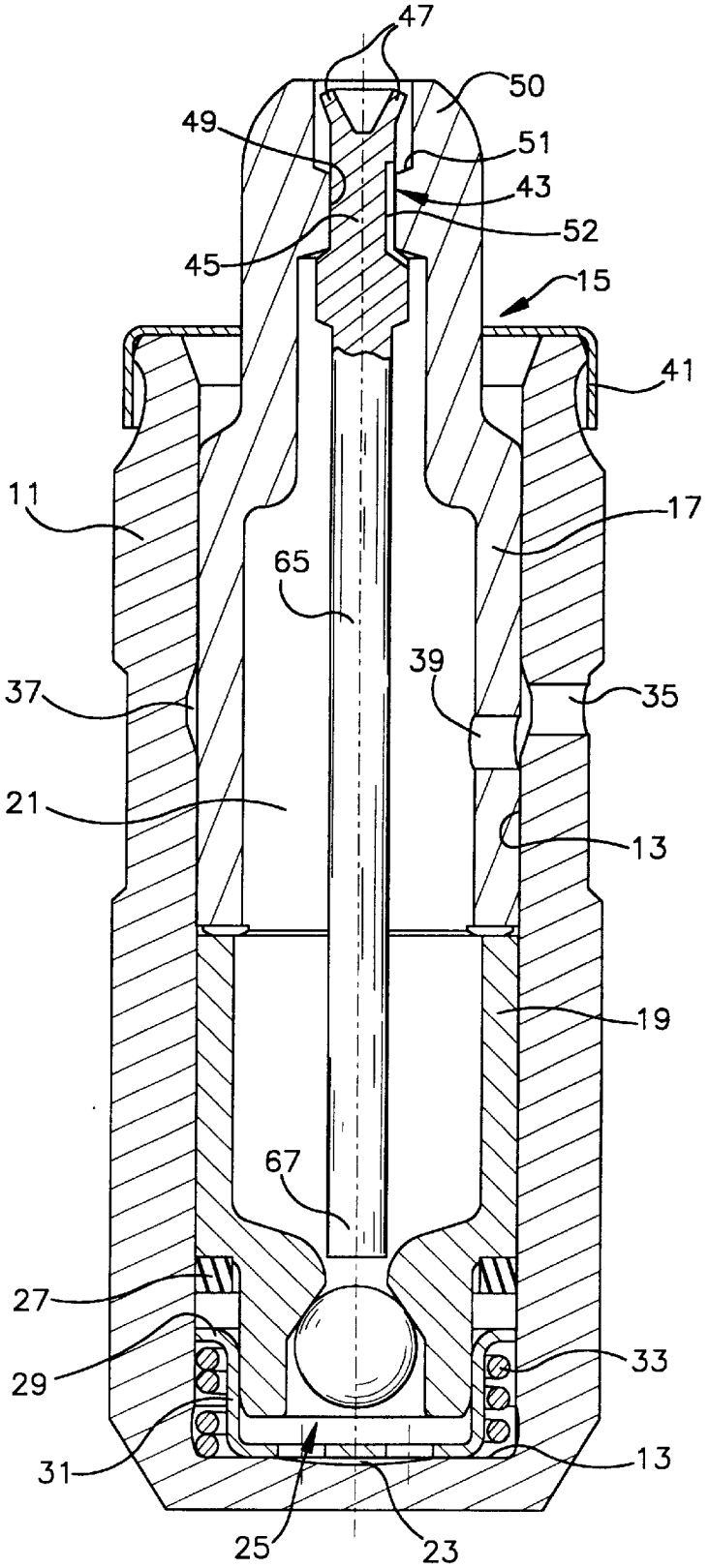
FIG. 1 is an axial cross-section of a lash adjuster made in accordance with the present invention, and with the plunger assembly check valve in the closed position.

Referring now to the drawings, which are not intended to limit the invention, FIG. 1 illustrates a hydraulic lash adjuster made in accordance with the teachings of the present invention.

The lash adjuster of the present invention comprises a body 11 defining a blind bore 13. A plunger assembly, generally designated 15 is slidably disposed within the blind bore 13, and includes an upper plunger element 17, and a lower plunger element 19. The plunger elements 17 and 19 cooperate to define a low pressure chamber 21 (also referred to hereinafter as a "reservoir"). The blind bore 13 and the plunger assembly 15 cooperate to define a high pressure chamber 23 (also referred to hereinafter as the "pressure chamber"), which is shown in its minimum volume position in both FIGS. 1 and 3. A check valve assembly, generally designated 25, is operable to permit fluid communication between the reservoir 21 and the pressure chamber 23.

Disposed between the lower plunger element 19 and the bore 13 is a dynamic seal member 27, against which is seated a flange 29 extending radially outwardly from a generally cup-shaped retainer 31. Although the subject embodiment is of the sealed reservoir type, it should be understood that the present invention can also be used advantageously in conventional leakdown type lash adjusters. Preferably, there is an interference fit between the retainer 31 and the reduced diameter portion of the lower plunger element 19. The plunger assembly 15 and the retainer 31 are maintained in the position shown by means of a plunger spring 33.

In the subject embodiment, hydraulic fluid is supplied to the low pressure chamber 21 through a port 35 which opens into the bore 13, and intersects a collector groove 37, formed about the inside diameter of the body 11. The groove 37 is positioned so that it intersects a port 39 defined by the upper plunger element 17, and opening into the low pressure chamber 21, the groove 37 being dimensioned so that it communicates with the port 39 throughout the full range of movement of the plunger assembly 15 within the body 11. A cap member 41 retains the plunger assembly 15 in a manner well known to those skilled in the art. Metered hydraulic fluid is supplied to the engine rocker arm (not shown) by means of a valve assembly, generally designated 43, which allows a limited flow of fluid outward from the plunger assembly 15, but which also acts as a check valve to prevent the inflow of air in the event of a low pressure or negative pressure condition within the chamber 21. The valve assembly 43, the details of which form no part of the present invention, is preferably made in accordance with the teachings of co-pending application U.S. Ser. No. 880,417, for a "IMPROVED METERING VALVE FOR BALL PLUNGER OR PUSHROD SOCKET", assigned to the assignee of the present invention, and incorporated herein by reference.

The valve assembly 43 is illustrated herein as including a pin 45 (sometimes referred to as a "metering" pin, or a "jiggle" pin) having outwardly extending portions 47 which can be compressed to snap the pin 45 into place through a port 49 formed in the a ball plunger portion 50 of the upper plunger element 17. Preferably, the outwardly extending portions 47 form a head near the upper end of the pin 45, and the head is operable to engage a seat 51 and serve as a check valve, so that, whenever fluid pressure is relatively low in the low pressure chamber 21, the check valve seats and prevents an inflow of air. In accordance with the teachings of the above-incorporated U.S. Ser. No. 880,417, the pin 45 defines an axially-extending fluid passage 52, thus providing a metered flow of lubrication fluid from the low pressure chamber 21 to the exterior of the ball plunger 50, whenever pressure within the chamber 21 is sufficient to bias the pin 45 to the position shown in FIG. 1.

Although the embodiment illustrated in FIG. 1 is a preferred embodiment, it will be understood by those skilled in the art that various other means, such as a gravity flow or a self-contained supply, can be provided to supply fluid to the low pressure chamber or reservoir 21, and that hydraulic fluid can be provided to the rocker arm by various other means, all within the scope of the present invention.

Figure 3:
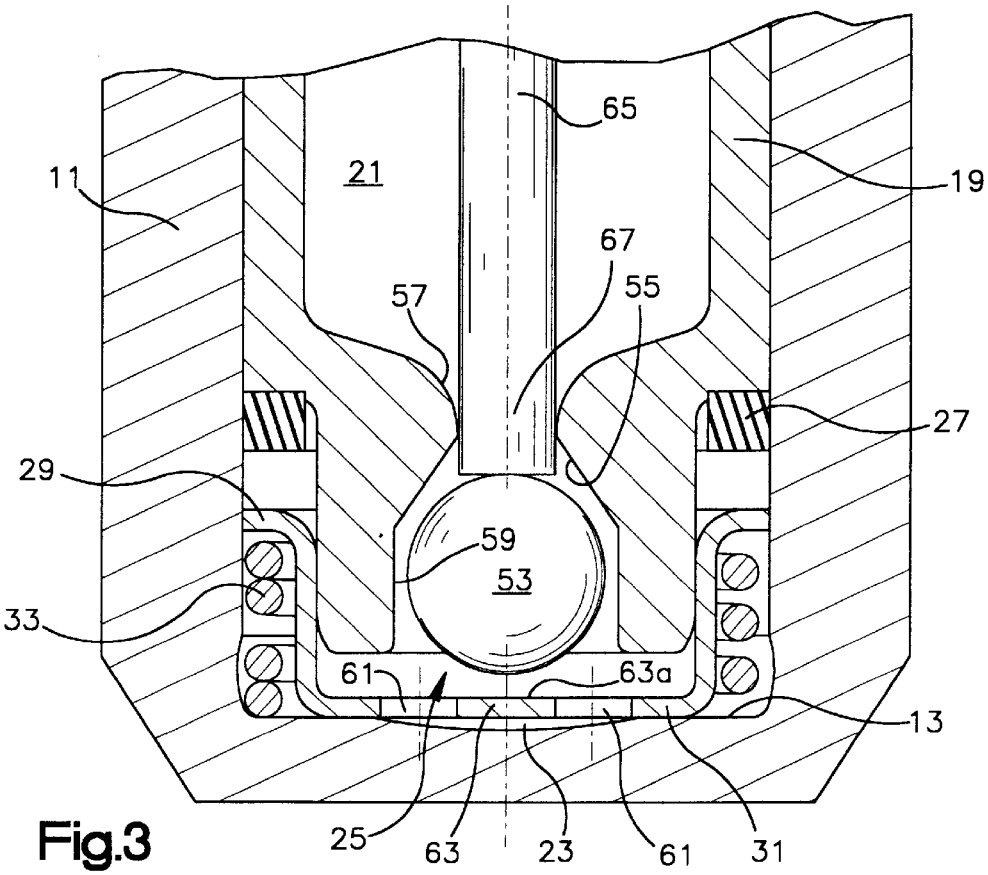
FIG. 3 is an enlarged, fragmentary, axial cross section, similar to FIG. 1, and corresponding to FIG. 2, but on a larger scale than FIG. 2, illustrating the check valve being lifted off its seat in accordance with the present invention.

Referring now to FIG. 3, in conjunction with FIG. 1, the check valve assembly 25 comprises a check ball 53 which is operable to engage a valve seat 55 which is defined by a surface formed between a valve opening 57 and a bore 59, the bore 59 being defined by the bottom of the lower plunger element 19. In its normal function as a check valve, the check ball 53 will be disposed away from the valve seat 55 when the plunger assembly 15 is moving upward, under the influence of the plunger spring 33, permitting hydraulic fluid to flow from the reservoir 21, through the valve opening 57 and the bore 59, into the high pressure chamber 23. In order to facilitate such flow, the retainer 31 defines a plurality of cut out areas 61, but preferably, the retainer 31 should include a solid, central portion 63, including an upper surface **63*a*, to limit the movement of the check ball 53, away from the valve seat 55, to the fully open position illustrated in FIG. 1**.

In accordance with an important aspect of the present invention, associated with the metering pin 45 is an elongated member 65, which is preferably formed integrally with the metering pin 45, at the upper end of the member 65. At its lower end, the elongated member 65 includes a lower terminal portion 67 which is disposed within the valve opening 57, and is juxtaposed the check ball 53, when the metering pin 45 is disposed toward its outward position, as shown in FIG. 1. In other words, during normal operation of the engine and the HLA, the elongated member 65 has no effect on the operation or performance of the HLA.

After the engine is shut off, or fluid pressure in the chamber 21 is substantially reduced, the metering pin 45 and elongated member 65 are no longer disposed toward the position shown in FIG. 1, but instead, fall until the terminal portion 67 of the member 65 engages the check ball 53, moving the check ball to its open position as shown in FIG. 3. However, in accordance with a preferred embodiment of the invention, the weight of the pin 45 and member 65 is insufficient to "lift" the check ball 53 off the valve seat 55, i.e., move the ball 53 downward in FIGS. 1 and 3. Thus, the pressure in the high pressure chamber 23 will keep the ball 53 seated, and the pin 45 and member 65 will simply "stand" on top of the ball 53.

Figure 2:
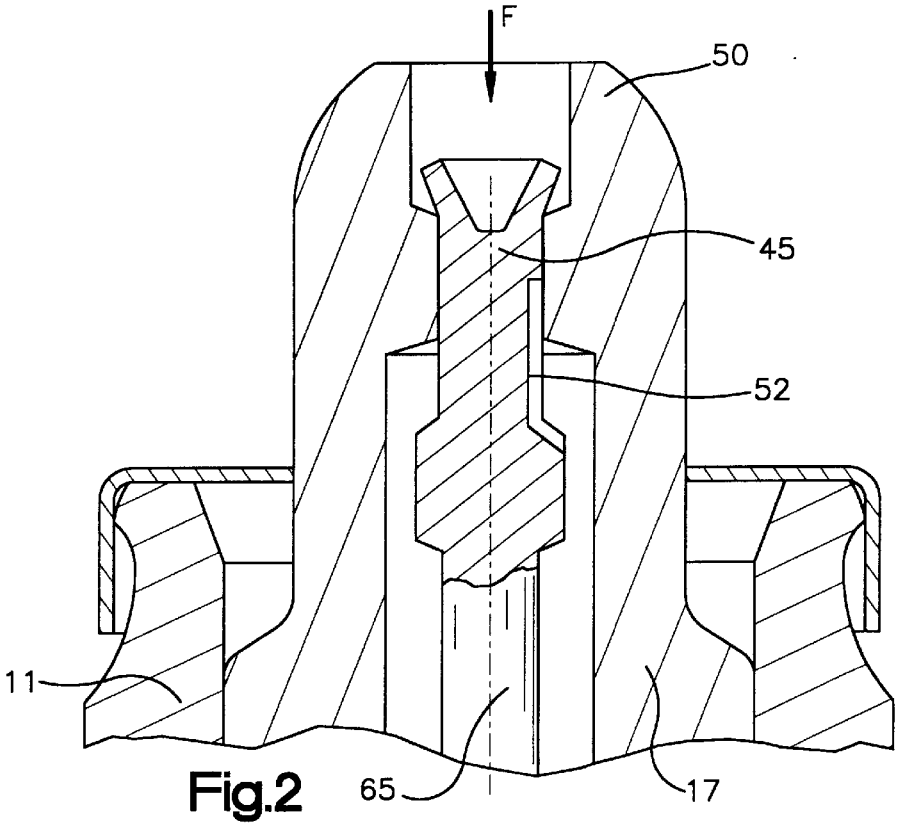
FIG. 2 is an enlarged, fragmentary, axial cross-section, similar to FIG. 1, illustrating the ball plunger metering pin in its inward position.

When it is desired to collapse the HLA, either for purposes of initial assembly, or for purposes of subsequent re-use or service, it is possible to do so by exerting a force on the pin 45 as indicated in FIG. 2 by the downward pointing arrow labeled "F". In some engine designs, it may be necessary to locate a hole in the rocker arm (not shown herein) just above the ball plunger 50, so that it is possible to place an appropriate tool in the hole and exert the indicated downward force on the pin 45. When the downward force is exerted on the pin 45 and member 65, they move downward to the positions shown in FIGS. 2 and 3, such that the terminal portion 67 engages the check ball 53 and lifts it off the seat 55, thus opening the valve opening 57. When the ball 53 is off the seat 55, fluid can flow rapidly from the high pressure chamber 23, past the seat 55, through the opening 57, and into the low pressure chamber 21. This flow permits the plunger assembly 15 (including both the plunger elements 17 and 19) to move downward (or "collapse"), thus facilitating assembly into the engine, or removal from the engine, of the HLA.

Although the subject embodiment of the invention has been illustrated and described in terms of a hydraulic lash adjuster of fairly conventional construction (i.e., a reciprocable plunger assembly within a fixed body), those skilled in the art will understand that the invention is not so limited. For example, the invention could be used in a HLA in which the ball plunger and the body are formed integrally, with the body surrounding a hydraulic plunger assembly. Also, there are a variety of plunger assembly configurations known, and the present invention could be equally applicable to at least most of them, and perhaps others as well.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A hydraulic lash adjuster for an internal combustion engine, said lash adjuster comprising a body defining a blind first bore therein; a plunger assembly slidingly received within said blind first bore; a pressure chamber defined by said blind first bore and said plunger assembly; a fluid chamber disposed within said plunger assembly, and a supply of hydraulic fluid within said fluid chamber; said plunger assembly defining a valve opening providing fluid communication between said pressure chamber and said fluid chamber; a check valve member operably associated with said valve opening for opening or closing said valve opening in response to a relative decrease or a relative increase, respectively, in the pressure in said pressure chamber; biasing means normally urging said plunger assembly outward of said blind first bore; said plunger assembly including a ball plunger element adapted for engagement with an adjacent surface of a valve train component, said ball plunger element defining a lubrication passage and a metering element reciprocally disposed within said lubrication passage, said metering element being movable between an outward position when pressure in said fluid chamber is relatively higher, and an inward position when pressure in said fluid chamber is relatively lower; characterized by:

(a) an elongated member operably associated with said metering element and including a lower end juxtaposed said valve opening and said check valve member when said metering element is in said outward position; and (b) said elongated member being configured to engage said check valve member and lift said check valve member to open said valve opening when said metering element is in said inward position.

2. A hydraulic lash adjuster as claimed in claim 1, characterized by seal means disposed between said blind first bore and said plunger assembly, operable to prevent substantially the flow of fluid therebetween.

3. A hydraulic lash adjuster as claimed in claim 1, characterized by said plunger assembly defining a second bore disposed in the bottom of said plunger assembly and in open communication with said valve opening, said check valve member being disposed in said second bore.

4. A hydraulic lash adjuster as claimed in claim 3, characterized by said plunger assembly including means operable to limit movement of said check valve member as it opens said valve opening, said limiting means including a retainer in engagement with the bottom of said plunger assembly, and in engagement with said check valve member in a fully open position.

5. A hydraulic lash adjuster as claimed in claim 1, characterized by said elongated member being formed integrally with said metering element.

* * * * *